US008809659B2

(12) United States Patent
Osuga et al.

(10) Patent No.: US 8,809,659 B2
(45) **Date of Patent: *Aug. 19, 2014**

(54) KEYBOARD DEVICE FOR ELECTRONIC MUSICAL INSTRUMENT

(71) Applicant: Yamaha Corporation, Hamamatsu (JP)

(72) Inventors: Ichiro Osuga, Hamamatsu (JP); Kenichi Nishida, Hamamatsu (JP); Shunsuke Ichiki, Hamamatsu (JP); Hiroshi Harimoto, Hamamatsu (JP); Shin Yamamoto, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/769,238

(22) Filed: Feb. 15, 2013

(65) Prior Publication Data

US 2013/0205971 A1 Aug. 15, 2013

(30) Foreign Application Priority Data

Feb. 15, 2012 (JP) ..... 2012-30403

(51) Int. Cl.
*G10C 3/12* (2006.01)

(52) U.S. Cl.
USPC ..... 84/439

(58) Field of Classification Search
USPC ..... 84/423 R, 430, 433–439, 441, 3, 24–26
See application file for complete search history.

(56) References Cited

U.S. PATENT DOCUMENTS

| | | | | |
|---|---|---|---|---|
| 2008/0121093 | A1* | 5/2008 | Izutani et al. | 84/745 |
| 2011/0005370 | A1 | 1/2011 | Kitajima | |
| 2011/0185876 | A1* | 8/2011 | Fujiwara et al. | 84/21 |

FOREIGN PATENT DOCUMENTS

| | | | |
|---|---|---|---|
| EP | 1998318 | A2 | 12/2008 |
| EP | 1998318 | A3 | 12/2008 |
| JP | 04-347895 | A | 12/1992 |
| JP | 04-350697 | A | 12/1992 |
| JP | 05-090586 | U | 12/1993 |
| JP | 08-076756 | A | 3/1996 |
| JP | 08-106281 | A | 4/1996 |
| JP | 3074794 | B2 | 8/2000 |
| JP | 2005-010418 | A | 1/2005 |
| JP | 2005-208244 | A | 8/2005 |

OTHER PUBLICATIONS

European Search Report mailed Jul. 3, 2013, for EP Patent Application No. 13155008.9, seven pages.

* cited by examiner

*Primary Examiner* — Kimberly Lockett
(74) *Attorney, Agent, or Firm* — Morrison & Foerster LLP

(57) ABSTRACT

A keyboard device includes plural white and black keys 11*w*, 11*b* that rock according to a key depression/release operation. Positions of key support portions 13*w*, 13*b* supporting the plural white and black keys 11*w*, 11*b* in the longitudinal direction are set to be different from one another. The keyboard device also includes hammers 16*w*, 16*b* that rock with the rocking movement of the plural white and black keys 11*w*, 11*b*. The plural white and black keys 11*w*, 11*b* include drive units 11*w*1, 11*b*1 that drive the hammers 16*w*, 16*b*. The pivot centers of the hammers are located on the same straight line extending in the lateral direction. The drive unit 11*b*1 is located anterior to the drive unit 11*w*1. An upper-limit stopper 21 and a lower-limit stopper 20, which restrict the rocking movement of the hammers 16*w*, 16*b*, are provided to extend in the lateral direction.

12 Claims, 10 Drawing Sheets

KEYBOARD DEVICE FOR ELECTRONIC MUSICAL INSTRUMENT

BACKGROUND OF THE INVENTION

1. Field of the Invention

The present invention relates to a keyboard device for an electronic musical instrument such as an electronic organ, an electronic piano, and the like.

2. Description of the Related Art

There has conventionally been known a keyboard device for an electronic musical instrument described in Japanese Patent No. 3074794. In this keyboard device described above, a key touch feeling (reaction force against a key depression/release operation) on a front end of a key, to which a higher pitch is assigned, is set lighter in order to generate a key touch feeling similar to a key touch feeling of an acoustic piano. This keyboard device has plural hammers, each of which rocks through an engagement with the corresponding key so as to apply reaction force against the depression/release operation of the corresponding key. The plural hammers are common components. In this keyboard device, the length from the pivot point of the key, formed on a back end, to the front end of the key becomes gradually longer toward the keys on the high-pitched side from the keys on the low-pitched side. In addition, the position of the pivot point of each hammer is gradually shifted backward from the low-pitched side toward the high-pitched side, by which the distance from the pivot point of the key to the engagement position between the hammer and the key is set to be the same for all keys.

The conventional keyboard device described above has a stopper for restricting the rocking movement of the key, and the maximum depth during the key depression is the same for all keys. However, since the pivot point of each hammer is shifted in the longitudinal direction, the range of the rocking angle of each hammer is different among the assigned pitches. Therefore, it is necessary to set the position and performance of a rubber switch, which is pushed by the rocking movement of the hammer, to be different among the assigned pitches. In order that the height of the front end of each key and the tilt angle of each key during the key release and the key depression are set to be the same for all keys to make the appearance of the keyboard device similar to the appearance of an acoustic piano, the position and thickness of the stopper for restricting the rocking movement of each key have to be different among the assigned pitches. Accordingly, a large variety of components are needed, so that the productivity of the keyboard device is low.

SUMMARY OF THE INVENTION

The present invention is accomplished to solve the above-mentioned problem, and aims to reduce cost for the keyboard device, which creates a key touch feeling and appearance similar to those of an acoustic piano by shifting the position of the pivot point of each key in the longitudinal direction, and to enhance productivity of the keyboard device. For easy understanding of the present invention, a numeral of a corresponding portion in an embodiment is written in a parenthesis in the description below of each constituent of the present invention. However, each constituent of the present invention should not be construed as being limited to the corresponding portion indicated by the numeral in the embodiment.

In order to attain the foregoing object, the present invention provides a keyboard device for an electronic musical instrument, the keyboard device including: plural white keys and black keys (11*w*, 11*b*) that are supported by a key support portion (Kw, Kb) in order that front ends thereof rock in the vertical direction by a key depression/release operation by a performer, wherein a pitch is assigned to each of the plural white keys and black keys, and a length from the front end to the key support portion is different among the plural white keys and black keys; plural white-key hammers and black-key hammers (16*w*, 16*b*), each of which includes an engagement portion (Pw1, Pb1) engaged with each of the plural white keys and black keys, and each of which is supported by a hammer support portion (Hw, Hb) in order to rock with the rocking movement of each of the plural white keys and black keys, wherein positions of the hammer support portions in the vertical direction and in the longitudinal direction are the same for the plural white-key hammers and black-key hammers, the positions of the engagement portions in the vertical direction and in the longitudinal direction during the key release state are the same for the plural white-key hammers, the positions of the engagement portions in the vertical direction and in the longitudinal direction during the key release state are the same for the plural black-key hammers, and the engagement portions of the plural black-key hammers are located anterior to the engagement portions of the plural white-key hammers; and a first restricting member (20) and a second restricting member (21) that are arranged to extend in the direction of the arrangement of the plural white keys and black keys, and that restrict the rocking movement of the plural white-key hammers and black-key hammers in order that the range of the rocking angle becomes the same for all of the plural white-key hammers and black-key hammers.

In this case, it is preferable that the distance (Lw1) from the front end of the white key to the engagement portion in the longitudinal direction is set within 30% of the distance (Lw2) from the front end of the white key to the key support portion of the white key in the longitudinal direction, and the distance (Lb1) from the front end of the black key to the engagement portion in the longitudinal direction is set within 30% of the distance (Lb2) from the front end of the black key to the key support portion of the black key in the longitudinal direction. The front end of the black key means a front end of a portion of the black key that can be visually recognized by a performer when the black key and the two white keys adjacent to the black key are released. The engagement portion of the black key may be provided anterior to the front end of the black key (see FIGS. 3, 7, and 9).

The distance from the leading end to the hammer support portion is the same for all of the plural white-key hammers and black-key hammers. Each of the plural white-key hammers includes a mass member that becomes light from a low-pitched side toward a high-pitched side, and a key touch feeling becomes gradually light from the low-pitched side toward the high-pitched side. Each of the plural black-key hammers includes a mass member that becomes light from a low-pitched side toward a high-pitched side, and a key touch feeling becomes gradually light from the low-pitched side toward the high-pitched side. The mass member for the white-key hammer is heavier than the mass member for the neighboring black-key hammer. The length from the front end to the back end of the plural white keys becomes shorter toward the high-pitched side from the low-pitched side, and the length from the front end to the back end of the plural black keys becomes shorter toward the high-pitched side from the low-pitched side.

In the keyboard device configured as described above, the range of the rocking angle is the same for all of the plural white-key hammers. Therefore, the maximum depth during the key depression in the vicinity of the engagement portion with the corresponding white-key hammer is also the same for plural white keys. In addition, the range of the rocking angle is the same for all of the plural black-key hammers. Therefore, the maximum depth during the key depression in the vicinity of the engagement portion with the corresponding black-key hammer is also the same for plural black keys. If the engagement portion is provided on the position near the front end of the key, in particular, a performer is easy to play the keyboard device, since the maximum depth on the front end of the key during the key depression is almost the same for all keys. The engagement portion of the black-key hammer is located anterior to the engagement portion of the white-key hammer. Therefore, the rocking range of the black-key hammer on the engagement portion is wider than the rocking angle of the white-key hammer on the engagement portion, so that the difference between the maximum depth of the front end of the black key during the key depression and the maximum depth of the front end of the white key during the key depression can be reduced. Specifically, the maximum depth of the front end of all keys during the key depression can be set to be almost the same for all keys, whereby the performer is easy to play the keyboard device.

The positions of the engagement portions in the vertical direction and in the longitudinal direction during the key release are the same for all of the plural white-key hammers, and the positions of the engagement portions in the vertical direction and in the longitudinal direction during the key release are the same for all of the plural black-key hammers. Therefore, plural white keys are easily engaged with the corresponding white-key hammers simultaneously during the assembling of the keys. In addition, plural black keys are easily engaged with the corresponding black-key hammers simultaneously during the assembling of the keys. Specifically, the workability of assembling the keys can be enhanced. The position of the hammer support portion is the same for all hammers (i.e., the pivot center of the hammer is on the same axis) as described above. Accordingly, if the first restricting member and the second restricting member extend in the direction of the arrangement of the keys, the position of the contact portion between the plural white-key hammers and black-key hammers and the first and second restricting members in the vertical direction and in the longitudinal direction can be the same. Specifically, since the first restricting member and the second restricting member restrict the rocking movement of the plural hammers, the number of components can be reduced, compared to the case in which the restricting member is provided for each hammer, resulting in that the cost for the keyboard device can be reduced.

According to another aspect, the keyboard device includes plural white-key operation detecting units and plural black-key operation detecting units (SW1) that are arranged in a line in a direction of the arrangement of the plural white keys and black keys, each white-key operation detecting unit and black-key operation detecting unit detecting a physical amount involved with the rocking movement of each of the plural white keys and black keys respectively. In this case, it is preferable that the distance (Lw3) from the front end of the white key to the white-key operation detecting unit corresponding to this white key in the longitudinal direction is set within 30% of the distance (Lw2) from the front end of the white key to the key support portion of the white key in the longitudinal direction, and the distance (Lb3) from the front end of the black key to the black-key operation detecting unit corresponding to this black key in the longitudinal direction is set within 30% of the distance (Lb2) from the front end of the black key to the key support portion of the black key in the longitudinal direction. The white-key operation detecting unit is a switch for detecting whether the white key is depressed or released, and the black-key operation detecting unit is a switch for detecting whether the black key is depressed or released.

As described above, the maximum depth in the vicinity of the front end of the key during the key depression is almost the same for all keys. Therefore, if the white-key operation detecting units and the black-key operation detecting units are configured to have the same characteristic, and are arranged in the direction of the arrangement of the keys (in the lateral direction), the relationship between the outputs from the white-key operation detecting unit and the black-key operation detecting unit and the depth of the key during the key depression can be almost the same for all of the white-key operation detecting units and the black-key operation detecting units. If the white-key operation detecting units and the black-key operation detecting units are arranged in the vicinity of the front end of the key, in particular, the relationship between the outputs from the white-key operation detecting unit and the black-key operation detecting unit and the depth of the key during the key depression can be almost the same for all of the white-key operation detecting units and black-key operation detecting units. Accordingly, the variety of the components can be reduced, whereby the cost for the keyboard device can be reduced. In addition, the depth of each key during the key depression can be detected by the same process in the electronic musical instrument provided with the keyboard device.

According to another aspect of the present invention, the keyboard device includes plural white-key hammer operation detecting units and black-key hammer operation detecting units (SW2) that are arranged in a line in a direction of the arrangement of the plural white keys and black keys, each white-key hammer operation detecting unit and black-key hammer operation detecting unit detecting a physical amount involved with the rocking movement of each of the plural white-key hammers and black-key hammers respectively. In this case, the white-key hammer operation detecting unit is a switch for detecting whether the white key is depressed or released, and the black-key hammer operation detecting unit is a switch for detecting whether the black key is depressed or released.

The range of the rocking angle is the same for all hammers as described above. Therefore, if the white-key hammer operation detecting units and the black-key hammer operation detecting units are configured to have the same characteristic, and are arranged in the lateral direction, the relationship between the outputs from the white-key hammer operation detecting unit and the black-key hammer operation detecting unit and the rocking angle of the white-key hammer and the black-key hammer can be almost the same for all of the white-key hammer operation detecting units and the black-key hammer operation detecting units. Accordingly, the variety of the components can be reduced, whereby the cost for the keyboard device can be reduced. In addition, the rocking angle of each hammer can be detected by the same process in the electronic musical instrument provided with the keyboard device.

According to another aspect of the present invention, the keyboard device includes plural white-key hammer driving units and black-key hammer driving units (SD1 to SD3) that are arranged in a line in a direction of the arrangement of the plural white keys and black keys, each white-key hammer driving unit and black-key hammer driving unit driving each of the plural white-key hammers and each of the plural black-key hammers respectively. The range of the rocking angle is the same for all of the plural white-key hammers and plural black-key hammers as described above. Therefore, if the white-key hammer driving units and the black-key hammer driving units are configured to have the same characteristic, and are arranged in the lateral direction, the same drive signal can be supplied to the plural white-key hammer driving units and the plural black-key hammer driving units. Specifically, it is unnecessary to adjust the drive signal for each of the hammers. The variety of the components can be reduced, whereby the cost for the keyboard device can be reduced.

BRIEF DESCRIPTION OF THE DRAWINGS

Various other objects, features and many of the attendant advantages of the present invention will be readily appreciated as the same becomes better understood by reference to the following detailed description of the preferred embodiment when considered in connection with the accompanying drawings, in which.

DESCRIPTION OF THE PREFERRED EMBODIMENT

One embodiment of the present invention will be described below with reference to the drawings. In the description below, a side close to a performer is defined as a "front side", while a side far from the performer is defined as a "rear side". A high-pitched side is defined as a "right side", while a low-pitched side is defined as a "left side".

Figure 1:
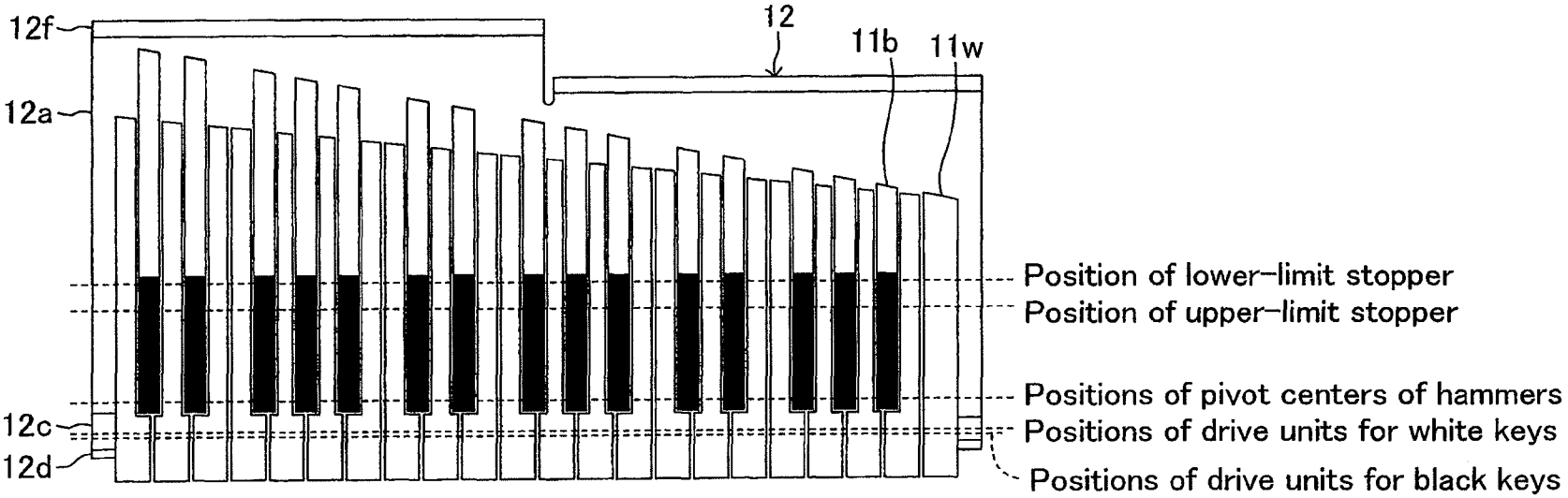
FIG. 1 is a plan view illustrating a keyboard device according to one embodiment of the present invention.
Figure 2:
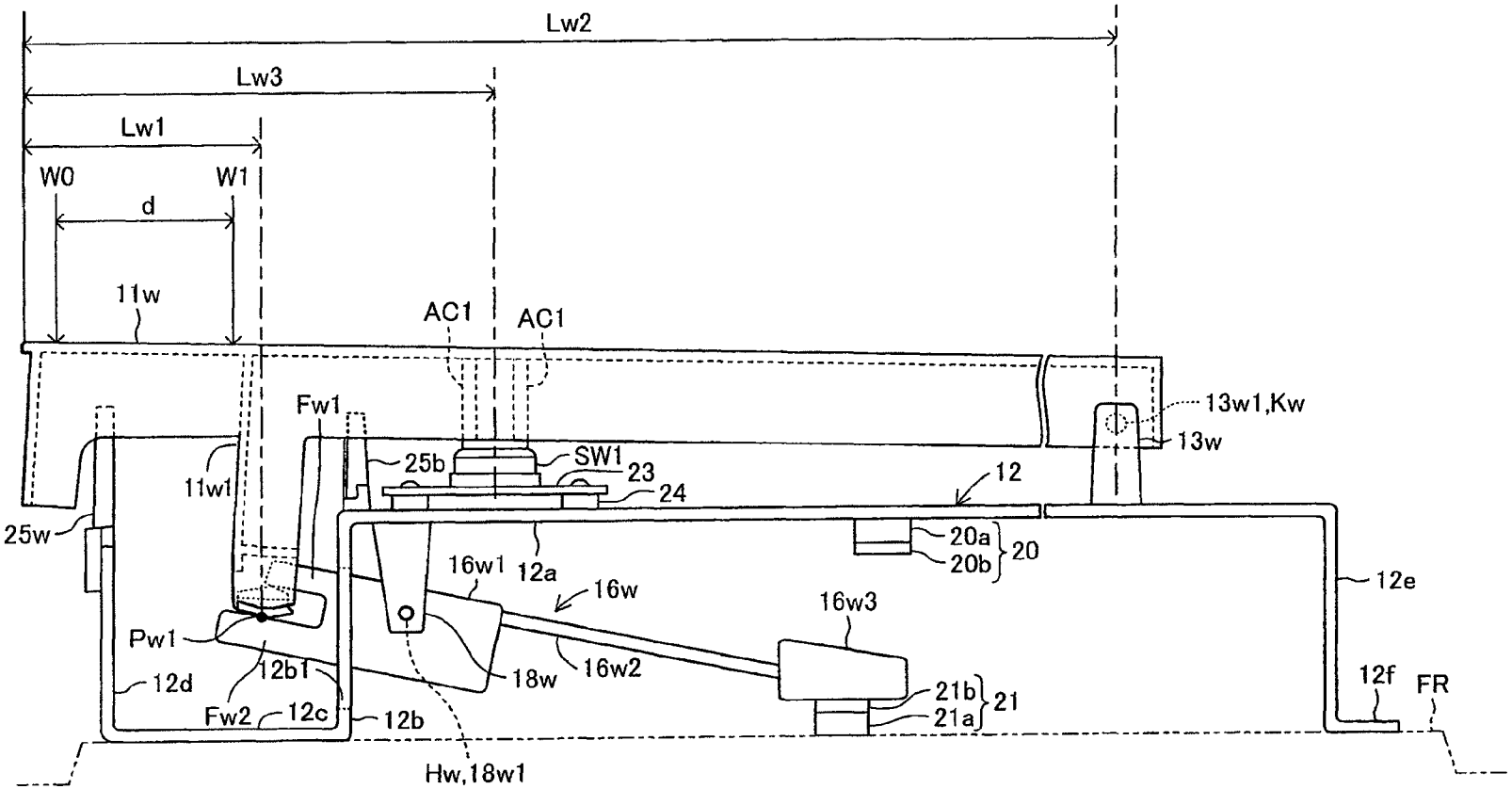
FIG. 2 is a right side view illustrating a configuration of a white key in the keyboard device illustrated in FIG. 1.
Figure 3:
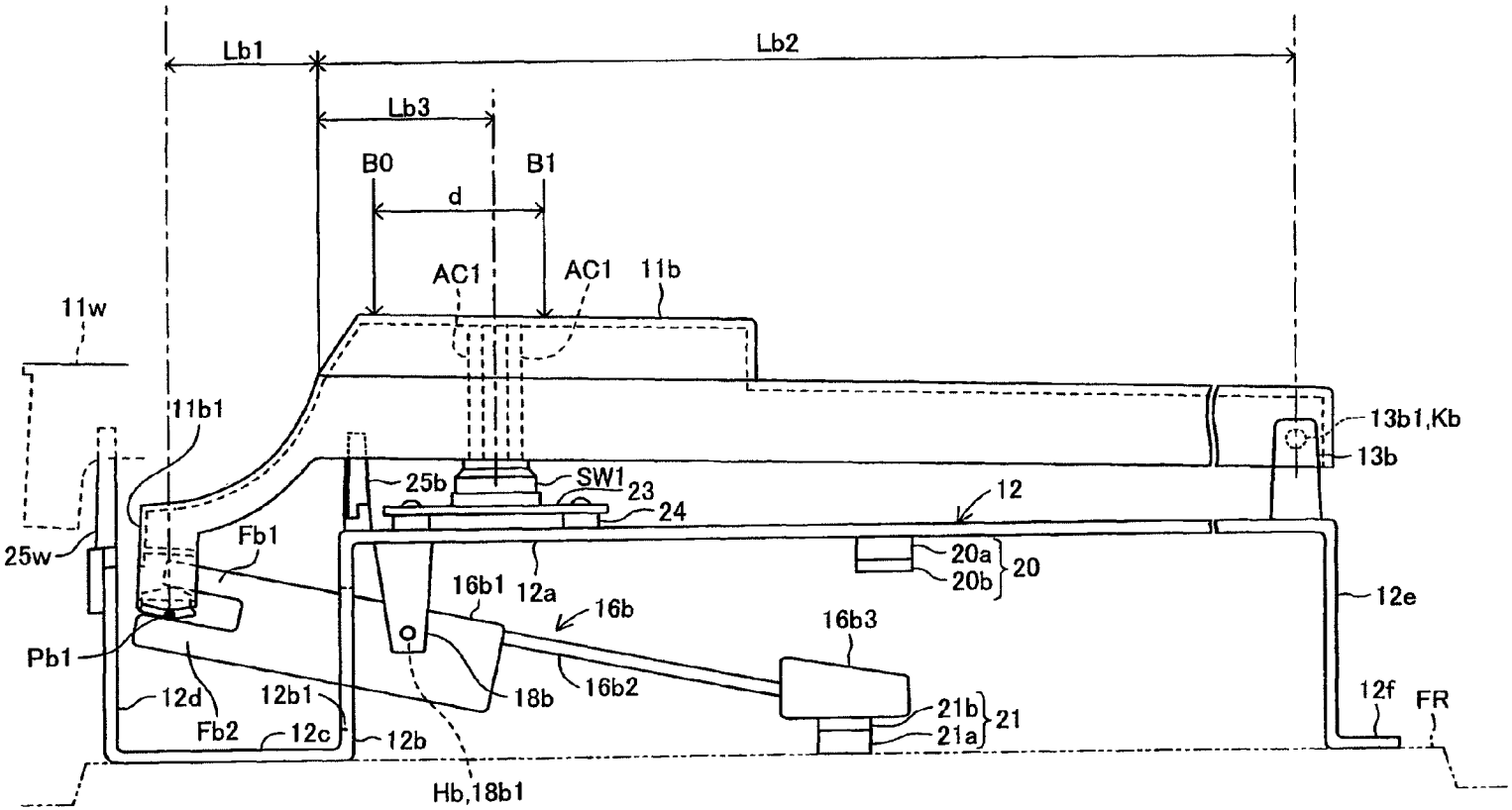
FIG. 3 is a right side view illustrating a configuration of a black key in the keyboard device illustrated in FIG. 1.

A keyboard device includes plural white keys 11*w* and plural black keys 11*b* as illustrated in FIGS. 1 to 3. A different pitch is assigned to each of plural white keys 11*w* and each of plural black keys 11*b*. In the present embodiment, one of "C3", "D3", . . . "C6" is assigned to the white keys 11*w*, while one of "C#3", "D#3", . . . "B#5" is assigned to the black keys 11*b*. The white keys 11*w* and black keys 11*b* are integrally formed to have a long shape by a synthetic resin. The white keys 11*w* are configured such that the length thereof is gradually shorter toward the white key 11*w* on the high-pitched side from the white key 11*w* on the low-pitched side. The black keys 11*b* are configured such that the length thereof is gradually shorter toward the black key 11*b* on the high-pitched side from the black key 11*b* on the low-pitched side. The back end of the black key 11*b* is located posterior to the back end of the adjacent white key 11*w*.

The white keys 11*w*, each having a different assigned pitch, have different length in the longitudinal direction, but the other structures are the same. The black keys 11*b*, each having a different assigned pitch, have different length in the longitudinal direction, but the other structures are the same. Each of the white keys 11*w* has a width in the vertical direction smaller than that of the black key 11*b*, and has a width in the lateral direction larger than that of the black key 11*b*. The white key 11*w* and the black key 11*b* have a hollow shape including a thin top wall extending in the longitudinal direction, and thin sidewalls extending downward from left and right ends of the top wall respectively, with no bottom. Through-holes Kw and Kb that are opposite to each other are formed on the rear part of the sidewall of the white key 11*w* and the black key 11*b*. The distance from the through-holes Kw and Kb to the back end of each key is the same for all keys. The white key 11*w* and the black key 11*b* are supported by a key support portion 13*w* and a key support portion 13*b* of a later-described key frame 12 with the through-holes Kw and Kb.

The key frame 12 has a top plate 12*a* extending in the longitudinal direction and lateral direction. The position of the front end of the top plate 12*a* at the low-pitched side and the position of the front end at the high-pitched side are the same, but the back end at the low-pitched side is located posterior to the back end at the high-pitched side. The key frame 12 also has a front plate 12*b* vertically extending downward from the front end of the top plate 12*a*, a bottom plate 12*c* horizontally extending from the lower end of the front plate 12*b*, and a front plate 12*d* vertically extending upward from the front end of the bottom plate 12*c*. The key frame 12 also includes a rear plate 12*e* vertically extending downward from the back end of the top plate 12*a*, and a bottom plate 12*f* horizontally extending rearward from the lower end of the rear plate 12*e*. The height of the lower surface of the bottom plate 12*c* and the height of the lower surface of the bottom plate 12*f* are the same. The keyboard device is supported by a frame FR of an electronic musical instrument by the structure in which the lower surface of the bottom plate 12*c* and the lower surface of the bottom plate 12*f* are brought into contact with the frame FR of the electronic musical instrument and fixed thereto. The above-described key support portion 13*w* and the key support portion 13*b* are formed to project upward from the upper surface of the top plate 12*a*. The key support portion 13*b* is located posterior to the adjacent key support portion 13*w*. The key support portion 13*w* and the key support portion 13*b* respectively include two opposing plates, and a projection 13*w*1 and projection 13*b*1 that project inward. The projections 13*w*1 and 13*b*1 are fitted to the through-holes Kw and Kb respectively. Therefore, the white key 11*w* and the black key 11*b* are supported to be rotatable about the projections 13*w*1 and 13*b*1, and their front ends can rock in the vertical direction.

A drive unit 11*w*1 extends downward from the middle portion of the white key 11*w*. The drive unit 11*w*1 has a hollow shape including a thin front wall extending in the vertical direction, and thin sidewalls extending rearward from left and right ends of the front wall, with no bottom. The lower end of the drive unit 11*w*1 is closed by a lower end wall. On the other hand, the black key 11*w* also has a drive unit 11*b*1 same as the drive unit 11*w*1 of the white key 11*w*. The black key 11*b* has a connection portion that extends downward from the front end of a portion (hereinafter referred to as an apparent portion of the black key 11*b*) projecting upward from the top surface of the white key 11*w* in a key-released state, and that is slightly curved to the front. The upper end of the drive unit 11*b*1 is connected to the leading end of the connection portion.

A distance Lw1 from the front end of the white key 11*w* to the drive unit 11*w*1 in the longitudinal direction is within 30% of a distance Lw2 from the front end of the white key 11*w* with the highest pitch (i.e., the shortest key of the plural white keys 11*w*) to the through-hole Kw. The distance Lw1 is the same for all white keys 11*w*. Specifically, the drive units 11*w*1 are arranged side by side in the lateral direction. A distance Lb1 from the front end of the apparent portion of the black key 11*b* to the drive unit 11*b*1 in the longitudinal direction is within 30% of a distance Lb2 from the front end of the apparent portion of the black key 11*b* with the highest pitch (e.g., the shortest key of the plural black keys 11*b*) to the through-hole Kb. The distance Lb1 is the same for all black keys 11*b*. Specifically, the drive units 11*b*1 are arranged side by side in the lateral direction. During the key release, the drive unit 11*b*1 is located anterior to the drive unit 11*w*1, and the lower end of the drive unit 11*b*1 is located slightly above the lower end of the drive unit 11*w*1.

The lower ends of the drive unit 11*w*1 and the drive unit 11*b*1 are respectively engaged with front ends of hammers 16*w* and 16*b* in the opening formed between the front plate 12*b* and the front plate 12*d*. In the key-released state, a contact portion Pw1 between the lower end of the drive unit 11*w*1 and the front end of the hammer 16*w* is located on the same straight line extending in the lateral direction (the direction parallel to the key arrangement direction). In the key-released state, a contact portion Pb1 between the lower end of the drive unit 11*b*1 and the front end of the hammer 16*b* is located on the same straight line extending in the lateral direction (the direction parallel to the key arrangement direction), and located anterior to the contact portion Pw1 and slightly above the contact portion Pw1.

The hammer 16*w* includes a base 16*w*1 made of synthetic resin, a connection rod 16*w*2 made of metal, and a mass member 16*w*3. Like the hammer 16*w*, the hammer 16*b* includes a base 16*b*1, a connection rod 16*b*2, and a mass member 16*b*3. The base 16*w*1 and the base 16*b*1 are plate-like members, and formed with through-holes Hw and Hb, respectively, from the right side face to the left side face. A hammer support portion 18*w* and a hammer support portion 18*b* are formed to project downward from the lower surface of the top plate 12*a*. The hammer support portions 18*w* and 18*b* are formed to have two opposing plates, and respectively have projections 18*w*1 and 18*b*1 projecting inward. The projections 18*w*1 and 18*b*1 are respectively fitted to the through-holes Hw and Hb. With this structure, the bases 16*w*1 and 16*b*1 are supported to be rotatable about the projections 18*w*1 and 18*b*1. Specifically, the hammer 16*w* and the hammer 16*b* are supported such that the front ends and the back ends can be rocked in the vertical direction. The positions of the hammer support portion 18*w* and the hammer support portion 18*b* in the longitudinal direction and in the vertical direction are the same for all hammers. Specifically, plural hammer support portions 18*w* and 18*b* are arranged side by side in the lateral direction, wherein the positions of the pivot center of the hammers 16*w* and 16*b* in the longitudinal direction and in the vertical direction are the same for all hammers 16*w* and 16*b*. In other words, the pivot centers of the hammers 16*w* and 16*b* are located on the same straight line extending in the lateral direction.

The base 16*w*1 includes a pair of leg portion Fw1 and leg portion Fw2 on its front end. The upper leg portion Fw1 is formed to be shorter than the lower leg portion Fw2. The base 16*b*1 is formed to be longer than the base 16*w*1 in the longitudinal direction, and its front end is located anterior to the leading end of the hammer 16*w*1. Like the base 16*w*1, the base 16*b*1 includes a pair of leg portion Fb1 and leg portion Fb2 on its front end. An elongated slit-like opening 12*b*1 extending in the vertical direction is formed on the front plate 12*b* for each of the hammers 16*w* and 16*b*. The front end of each hammer 16*w* and the front end of each hammer 16*b* project forward of the front plate 12*b* through the opening 12*b*1. The wall of the lower end of the drive unit 11*w*1 enters between the leg portions Fw1 and Fw2, while the wall of the lower end of the drive portion 11*b*1 enters between the leg portions Fb1 and Fb2. The leg portions Fw1 and Fb1 enter between the walls of the lower ends of the drive units 11*w*1 and 11*b*1 and intermediate walls that form gaps with the walls of the lower ends in the drive units 11*w*1 and 11*b*1. A shock absorbing material such as rubber, urethane, or felt is fitted and fixed on the wall of the lower end of each of the drive units 11*w*1 and 11*b*1. The shock absorbing material absorbs shock caused by the collision between the lower end of the drive unit Fw1 and the upper surface of the leg portion Fw2, the collision between the lower end of the drive unit Fb1 and the upper surface of the leg portion Fb2, the collision between the lower end of the drive unit 11*w*1 and the lower surface of the leg portion Fw1, and the collision between the lower end of the drive unit 11*b*1 and the lower surface of the leg portion Fb1.

The front end of the connection rod 16*w*2 and the front end of the connection rod 16*b*2 are assembled to the back end of the base 16*w*1 and the back end of the base 16*b*1, respectively. The connection rods 16*w*2 and 16*b*2 extend rearward. The position of the back end of the connection rod 16*w*2 and the position of the back end of the connection rod 16*b*2 in the longitudinal direction are the same. The mass member 16*w*3 and the mass member 16*b*3, described later, are assembled to the back end of the connection rod 16*w*2 and the back end of the connection rod 16*b*2, respectively.

As described above, the position of the pivot point of the key is different depending upon the assigned pitch. Therefore, the distance from the pivot center of the white key 11*w* to the contact portion Pw1 of the leg portion Fw2 and the drive unit 11*w*1 is different depending upon the assigned pitch. The distance from the pivot center of the black key 11*b* to the contact portion Pb1 of the leg portion Fb2 and the drive unit 11*b*1 is also different depending upon the assigned pitch. A key depression/release operation position W0 of the white key 11*w* that is the front end of the position of the white key 11*w* with the potentiality of being depressed or released is located anterior to the contact portion Pw1, while a key depression/release operation position B0 of the black key 11*b* that is the front end of the position of the black key 11*b* with the potentiality of being depressed or released is located posterior to the contact portion Pb1. Therefore, if the masses of the mass members for all hammers are equal, a key touch feeling is heavier on the middle-pitched part than on the low-pitched part, and the key touch feeling is heavier on the high-pitched part than on the middle-pitched part, on the key depression/release operation positions W0 and B0, because of the principle of leverage.

Figure 4:
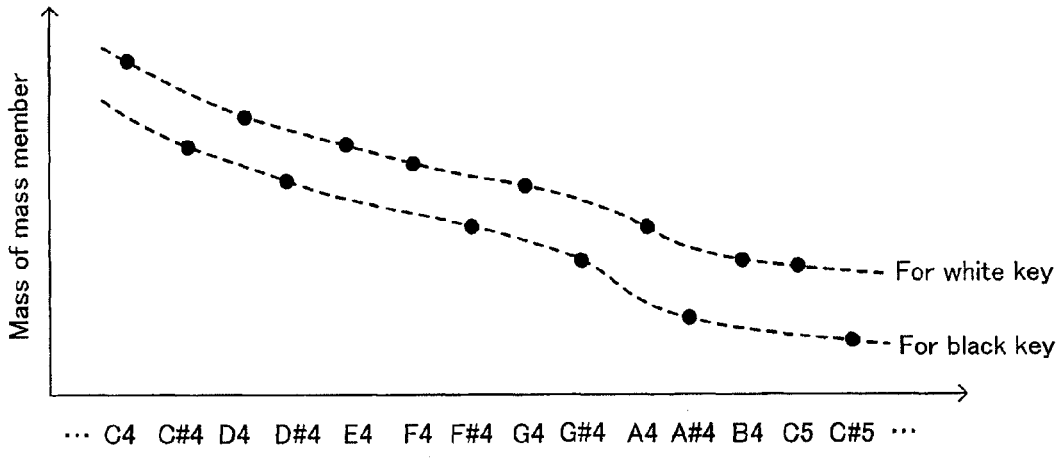
FIG. 4 is a graph of a characteristic curve illustrating a relationship between a pitch and a mass of a mass member.
Figure 5:
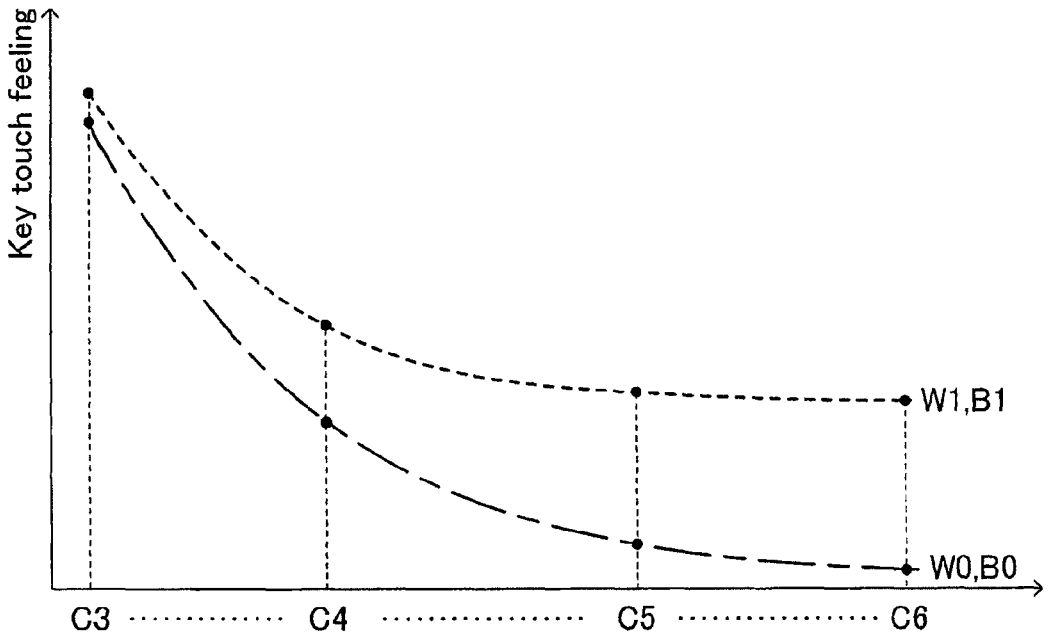
FIG. 5 is a graph of a characteristic curve illustrating a relationship between a pitch and a key touch.

In addition, in this case, the key touch feeling of the white keys 11*w* and the black keys 11*b* in each range is not equal. Specifically, the key touch feeling of the key 11*b* is heavier than the key touch feeling of the adjacent two white keys 11*w*. In view of this, the mass of the mass member 16*w*3 and the mass of the mass member 16*b*3 are adjusted for each key as illustrated in FIG. 4. Specifically, as illustrated in a characteristic curve indicating the masses of the mass members 16*w*3 and 16*b*3 in the order of pitches, the masses of the mass members 16$w$3 and 16$b$3 are adjusted such that the characteristic curve of the mass member 16$w$3 and the characteristic curve of the mass member 16$b$3 are parallel downward-sloping curves, wherein the characteristic curve of the mass member 16$b$3 is located below the characteristic curve of the mass member 16$w$3. In other words, the mass member 16$w$3 for the white key 11$w$ is heavier than the mass member 16$b$3 for the neighboring black key 11$b$. Thus, as illustrated by a chain line in FIG. 5, the key touch feeling on the key depression/release operation positions W0 and B0 becomes gradually lighter toward the high-pitched side from the low-pitched side. Therefore, as illustrated by a broken line in FIG. 5, the key touch feeling on key depression/release operation positions W1 and B1 located posterior to the key depression/release operation positions W0 and B0 by a distance d also becomes gradually lighter toward the high-pitched side from the low-pitched side. Since the length of the key to which a higher pitch is assigned is shorter, the difference between the key touch feeling on the key depression/release operation positions W0 and B0 and the key touch feeling on the key depression/release operation positions W1 and B1 becomes larger toward the high-pitched side from the low-pitched side. Specifically, the difference in the key touch feeling caused by the longitudinal difference of the key depression/release operation position is small on the low-pitched side, moderate in the middle-pitched side, and large on the high-pitched side.

When the white key 11$w$ and the black key 11$b$ are released, the front ends of the hammers 16$w$ and 16$b$ displace upward due to their own weight of the hammers 16$w$ and 16$b$. In this case, the drive unit 11$w$1 and the drive unit 11$b$1 are biased upward by the leg portion Fw2 and the leg portion Fb2 respectively, whereby the front ends of the white key 11$w$ and the black key 11$b$ displace upward. On the other hand, when the white key 11$w$ and the black key 11$b$ are depressed, the lower surfaces of the drive unit 11$w$1 and the drive unit 11$b$1 press the upper surfaces of the leg portion Fw2 and the leg portion Fb2 respectively, whereby the front ends of the hammer 16$w$ and the hammer 16$b$ respectively displace downward.

A lower-limit stopper 20 is provided to the key frame 12. During the key depression, the lower-limit stopper 20 is brought into contact with the upper surfaces of the mass member 16$w$3 and the mass member 16$b$3 of the hammer 16$w$ and the hammer 16$b$ so as to restrict the upward displacement of the back ends of the hammer 16$w$ and the hammer 16$b$, thereby restricting the downward displacement of the front ends of the white key 11$w$ and the black key 11$b$. The lower-limit stopper 20 includes a stopper rail 20$a$ and a buffer material 20$b$. The stopper rail 20$a$ protrudes downward from the lower surface at the middle of the top plate 12$a$, and extends in the lateral direction. The stopper rail 20$a$ is located above the mass member 16$w$3 and the mass member 16$b$3. The projection amount of the stopper rail 20$a$ from the lower surface of the top plate 12$a$ on the contact portion between the stopper rail 20$a$ and each hammer is constant in the lateral direction. The buffer material 20$b$ is fixed to the lower end surface of the stopper rail 20$a$. The buffer material 20$b$ is a long member made of a shock-absorbing material such as rubber or felt. The sectional shape of the buffer material 20$b$ is uniform from one end to the other end.

An upper-limit stopper 21 is provided to the middle portion of the frame FR. During the key release, the upper-limit stopper 21 is brought into contact with the lower surfaces of the mass member 16$w$1 and the mass member 16$b$1 of the hammer 16$w$ and the hammer 16$b$ so as to restrict the downward displacement of the back ends of the hammer 16$w$ and the hammer 16$b$, thereby restricting the upward displacement of the front ends of the white key 11$w$ and the black key 11$b$. Like the lower-limit stopper 20, the upper-limit stopper 21 includes a stopper rail 21$a$ and a buffer material 21$b$. Specifically, the stopper rail 21$a$ also extends in the lateral direction, and the projection amount thereof from the frame FR is constant in the lateral direction. The buffer material 21$b$ is fixed on the upper surface of the stopper rail 21$a$. Like the buffer material 20$b$, the sectional shape of the buffer material 21$b$ is uniform from one end to the other end. The stopper rail 20$a$ and the stopper rail 21$a$ may continuously extend in the lateral direction, or may discontinuously extend. The stopper rail 20$a$ and the stopper rail 21$a$ may be formed integral with the top plate 12$a$ and the frame FR respectively, or may be formed as separate components and assembled to the top plate 12$a$ and the frame FR respectively.

A switch drive unit AC1 is provided on the lower surface of each of the white key 11$w$ and the black key 11$b$ on the middle part. The switch drive unit AC1 is a plate-like member extending in the vertical direction in each of the white key 11$w$ and the black key 11$b$, and the lower end surface of the switch drive unit AC1 is brought into contact with the upper surface of a switch SW1. The switch SW1 is provided for each key. The switch SW1 is pressed by the corresponding key to detect whether the corresponding key is depressed or released. Specifically, when the switch SW1 is depressed by the key, a rubber main body is deformed to make two contacts, which are formed on a circuit board 23, short-circuit, thereby being turned ON. The circuit board 23 extends in the lateral direction. A through-hole penetrating from the upper surface to the lower surface is formed on the circuit board 23. The through-hole corresponds to a boss 24 formed integral with the upper surface of the top plate 12$a$. When a screw is threaded to the boss 24 through the through-hole, the circuit board 23 is fixed to the key frame 12. The main bodies of the plural switches SW1, each corresponding to each key, are arranged on the upper surface of the circuit board 23 in the lateral direction. The position of the switch SW1 for the white key 11$w$ and the position of the switch SW1 for the black key 11$b$ in the longitudinal direction are the same. A distance Lw3 from the front end of the white key 11$w$ to the switch SW1 in the longitudinal direction is within 30% of the distance Lw2 from the front end of the white key 11$w$ with the highest pitch to the through-hole Kw, and a distance Lb3 from the front end of the apparent portion of the black key 11$b$ to the switch SW1 is within 30% of the distance Lb2 from the front end of the apparent portion of the black key 11$b$ with the highest pitch to the through-hole Kb. The switch SW1 for the white key 11$w$ and the switch SW1 for the black key 11$b$ may be arranged side by side in the lateral direction, and the positions of both switches in the longitudinal direction may be shifted.

A key guide 25$w$ for guiding the rocking movement of the white key 11$w$ is formed to project upward from the top end surface of the front plate 12$d$. The key guide 25$w$ is inserted into the white key 11$w$ from below, and during the key depression and key release, the side face of the key guide 25$w$ and the inside face of the sidewall of the white key 11$w$ are in sliding contact with each other. This structure can prevent a slight displacement of the white key 11$w$ in the lateral direction during the key depression and key release.

A key guide 25$b$ for guiding the rocking movement of the black key 11$b$ is formed to project upward from the upper surface of the top plate 12$a$ at the front end. The key guide 25$b$ is inserted into the black key 11$b$ from below, and during the key depression and key release, the side face of the key guide 25$b$ and the inside face of the sidewall of the black key 11$b$ are in sliding contact with each other. This structure can prevent a slight displacement of the black key 11*b* in the lateral direction during the key depression and key release.

In the keyboard device having the configuration described above, all components of the hammers 16*w*, except for the mass members 16*w*3, are the same for all hammers 16*w*. In addition, all components of the hammers 16*b*, except for the mass members 16*b*3, are the same for all hammers 16*b*. Accordingly, the variety of the components can be reduced, so that the cost for the keyboard device can be reduced. The positions of the pivot centers of the hammers in the longitudinal direction and in the vertical direction are the same for all hammers, and the positions of the upper-limit stopper 21 and the lower-limit stopper 20 in the longitudinal direction and in the vertical direction are the same for all hammers. Therefore, the upper-limit stopper 21 and the lower-limit stopper 20 can easily be assembled. The number of components can be reduced, compared to the case in which the stopper is provided for each hammer, resulting in that the cost for the keyboard device can be reduced. As described above, the positions of the pivot centers of the hammers and the positions of the upper-limit stopper 21 and the lower-limit stopper 20 in the longitudinal direction and in the vertical direction are the same for all hammers. Therefore, the ranges of the rocking angle of the hammers can be the same for all hammers.

In the present embodiment, when the white key 11*w* is assembled to the key frame 12, the wall of the lower end of the drive unit 11*w*1 has to be inserted between the leg portion Fw1 and the leg portion Fw2. When the black key 11*b* is assembled to the key frame 12, the wall of the lower end of the drive unit 11*b*1 has to be inserted between the leg portion Fb1 and the leg portion Fb2. In the present embodiment, the position of the contact portion Pw1 in the longitudinal direction and in the vertical direction during the key release is the same for all white keys 11*w* and all hammers 16*w*, and the position of the contact portion Pb1 in the longitudinal direction and in the vertical direction during the key release is the same for all black keys 11*b* and all hammers 16*b*. With this structure, the walls of the lower ends of the drive units 11*w*1 for the plural white keys 11*w* are easy to be simultaneously inserted between the leg portions. In addition, the walls of the lower ends of the drive units 11*b*1 for the plural black keys 11*b* are easy to be simultaneously inserted between the leg portions. Specifically, plural keys can be assembled at a time, whereby an assembling property for assembling the white keys 11*w* and the black keys 11*b* to the key frame 12 can be enhanced.

Since the ranges of the rocking angles of the hammers are the same for all hammers, the rocking range of the contact portion Pw1 is the same for all white keys 11*w*. The rocking range just above the contact portion Pb1 is the same for all black keys 11*b*. In the present embodiment, the distance Lw1 is set to be sufficiently smaller than the distance Lw2. The distance Lb1 is set to be sufficiently smaller than the distance Lb2. Therefore, the maximum depth of the front end of the white key 11*w* during the key depression is the same for all white keys 11*w*, and the maximum depth of the front end of the black key 11*b* during the key depression is the same for all black keys 11*b*. Since the contact portion Pb1 is located anterior to the contact portion Pw1, the rocking range of the contact portion Pb1 is wider than the rocking range of the contact portion Pw1, so that the difference between the maximum depth of the front end of the apparent portion of the black key 11*b* during the key depression and the maximum depth of the front end of the white key 11*w* during the key depression can be reduced. Specifically, the maximum depth of the front end of the key during the key depression can be set to be the same for all keys, so that a performer is easy to play the keyboard device.

Plural switches SW1, each corresponding to each key, are arranged side by side in the lateral direction. The maximum depth of the front end of each key during the key depression is almost the same for all keys as described above. Therefore, if the switches SW1 are arranged side by side in the lateral direction near the front end of the key, the depth of the key during the key depression when the ON/OFF state of each switch SW1 is changed is almost the same. Therefore, this can realize that all switches SW1 have the same characteristics. Specifically, not only the variety of the components can be reduced to reduce the cost for the keyboard device, but also the key depression/release state of each key can be detected by the same process in the electronic musical instrument to which this keyboard device is applied. The circuit board 23 including the contacts of the plural switches SW1 is provided to extend in the lateral direction. Therefore, the assembling property for the assembling operation can be enhanced, compared to the case in which the switch SW1 is assembled for each key.

Upon embodying the present invention, the present invention is not limited to the above-described embodiment, and various modifications are possible without departing from the scope of the present invention.

For example, in the embodiment described above, the switches SW1 are provided posterior to the drive units 11*w*1 and 11*b*1 respectively. However, they may be provided anterior to the drive units 11*w*1 and 11*b*1. In this case, a horizontal portion extending forward or backward from the upper end of the front plate 12*d* may be provided, and the circuit board 23 may be mounted to the horizontal portion. The switch drive unit AC1 may be provided anterior to the drive units 11*w*1 and 11*b*1 and above the switch SW1. Even with this configuration, the effect same as that provided by the above-mentioned embodiment can be obtained. Instead of the switch SW1, or in addition to the switch SW1, an optical sensor, a magnetic sensor, a capacitance sensor, or a pressure-sensitive sensor may be used to detect whether the key is depressed or released.

In the present embodiment, the pivot centers of the hammers 16*w* and the hammers 16*b* are formed on the middle part of the respective hammers 16*w* and 16*b*. The engagement portions between the white key 11*w* and the hammer 16*w* as well as between the black key 11*b* and the hammer 16*b* are formed on the front end of the hammer 16*w* and the front end of the hammer 16*b*, respectively. However, the pivot center of each hammer and the position of the engagement portion are not limited to those described in the above embodiment. For example, the pivot centers may be formed on the back end of the hammer 16*w* and the back end of the hammer 16*b*. The engagement portions may be formed on the middle part of the hammer 16*w* and on the middle part of the hammer 16*b*, and the mass member 16*w*3 and the mass member 16*b*3 may be mounted on the front end of the hammer 16*w* and the front end of the hammer 16*b* respectively. In this case, the front ends of the hammer 16*w* and the hammer 16*b* are biased upward by an elastic member such as a spring or rubber during the key release. In this case too, the pivot centers of the respective hammers and the engagement portions may be arranged side by side in the lateral direction, and the stopper for restricting the rocking movement of the hammers 16*w* and 16*b* may be arranged in the lateral direction. Notably, it is set such that the engagement portion of the black key 11*b* is located anterior to the engagement portion of the white key 11*w* in the key-released state. Even with the configuration in which the front ends of the hammers 16*w* and 16*b* rock in the vertical direction about the back ends of the hammers 16*w* and 16*b* as described above, the effect same as that of the above-mentioned embodiment can be obtained.

For example, in the present embodiment, the mass member 16*w*3 and the mass member 16*b*3 are mounted to the back ends of the connection rod 16*w*2 and the connection rod 16*b*2. However, the mass member 16*w*3 and the mass member 16*b*3 are not mounted, but the leading ends of the connection rod 16*w*2 and the connection rod 16*b*2 may be folded back to the front so as to concentrate the mass on the back ends of the hammer 16*w* and the hammer 16*b*. By adjusting the length of the folded portion, the mass at the back ends of the hammer 16*w* and the hammer 16*b* may be adjusted.

Figure 6:
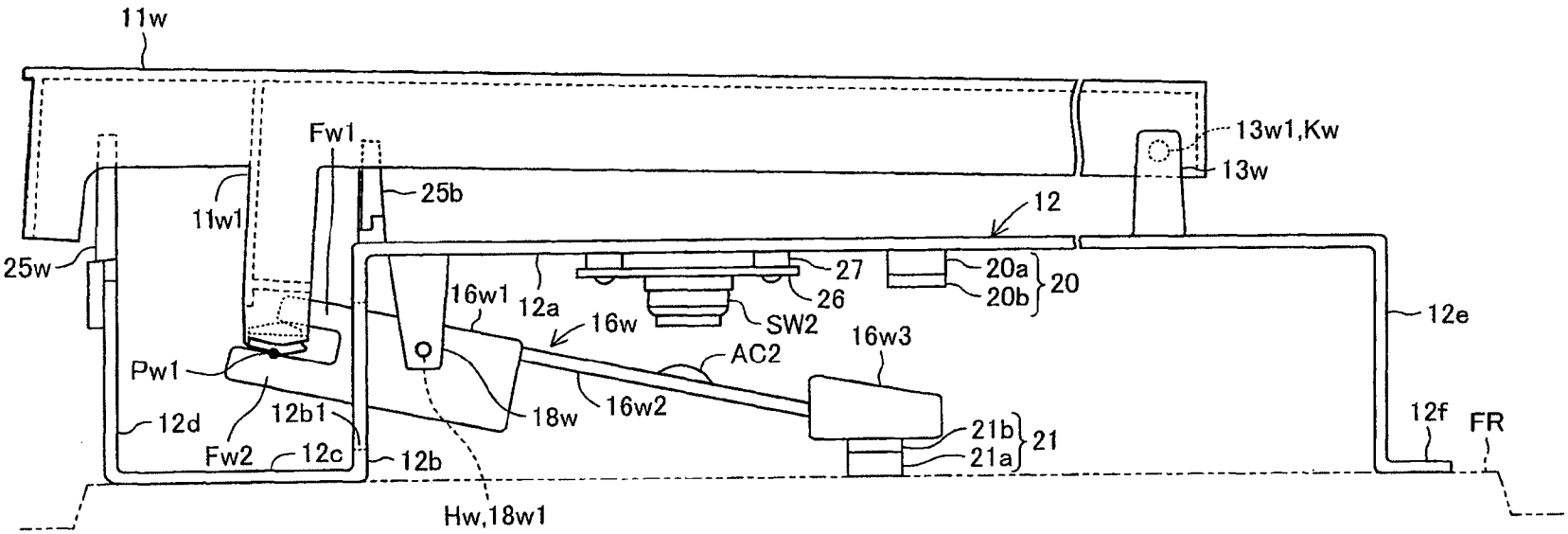
FIG. 6 is a right side view illustrating a configuration of a white key in a keyboard device according to a modification of the present invention.
Figure 7:
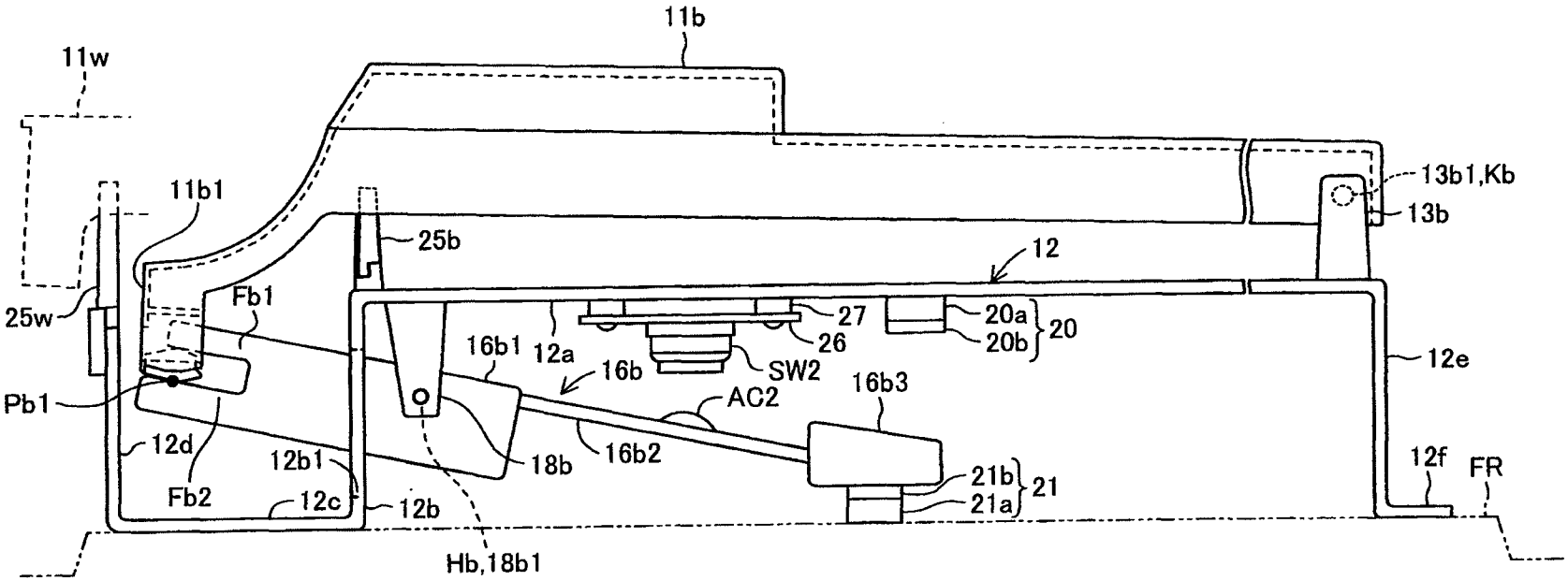
FIG. 7 is a right side view illustrating a configuration of a black key in a keyboard device according to a modification of the present invention.

For example, in the present embodiment, the switch SW1 that is pressed by the corresponding key, and detects whether the corresponding key is depressed or released is provided. However, instead of the switch SW1, a switch SW2 that is pressed by the hammer 16*w* or the hammer 16*b* to detect whether the corresponding key is depressed or released may be provided as illustrated in FIGS. 6 and 7. In this case, a circuit board 26 similar to the circuit board 23 may be provided to extend in the lateral direction on the lower surface of the top plate 12*a*. Specifically, a boss 27 may be provided on the lower surface of the top plate 12*a*, and the circuit board 26 may be mounted to the boss 27. The plural switches SW2, each corresponding to each hammer, may be arranged side by side in the lateral direction on the lower surface of the circuit board 26. Convex switch drive units AC2 that press the switches SW2 may be provided on the top surface of the connection rod 16*w*2 and on the top surface of the connection rod 16*b*2 on the middle part. The other configurations are the same as that of the above-mentioned embodiment, and they will not be repeated below. The switches SW2 may be provided in addition to the configuration of the embodiment described above.

The ranges of the rocking angle of the hammers are the same for all hammers as described above. Therefore, if the switches SW2 are arranged side by side in the lateral direction, the rocking angle of the hammer when the ON/OFF state of each switch SW2 is changed is almost the same for all hammers. Therefore, this can realize that all switches SW2 have the same characteristics. Specifically, not only the variety of the components can be reduced to reduce the cost for the keyboard device, but also the rocking angle of each hammer can be detected by the similar process in the electronic musical instrument to which this keyboard device is applied. The circuit board 26 including the contacts of the plural switches SW2 is provided to extend in the lateral direction. Therefore, the assembling property for the assembling operation can be enhanced, compared to the case in which the switch SW2 is assembled for each hammer.

Figure 8:
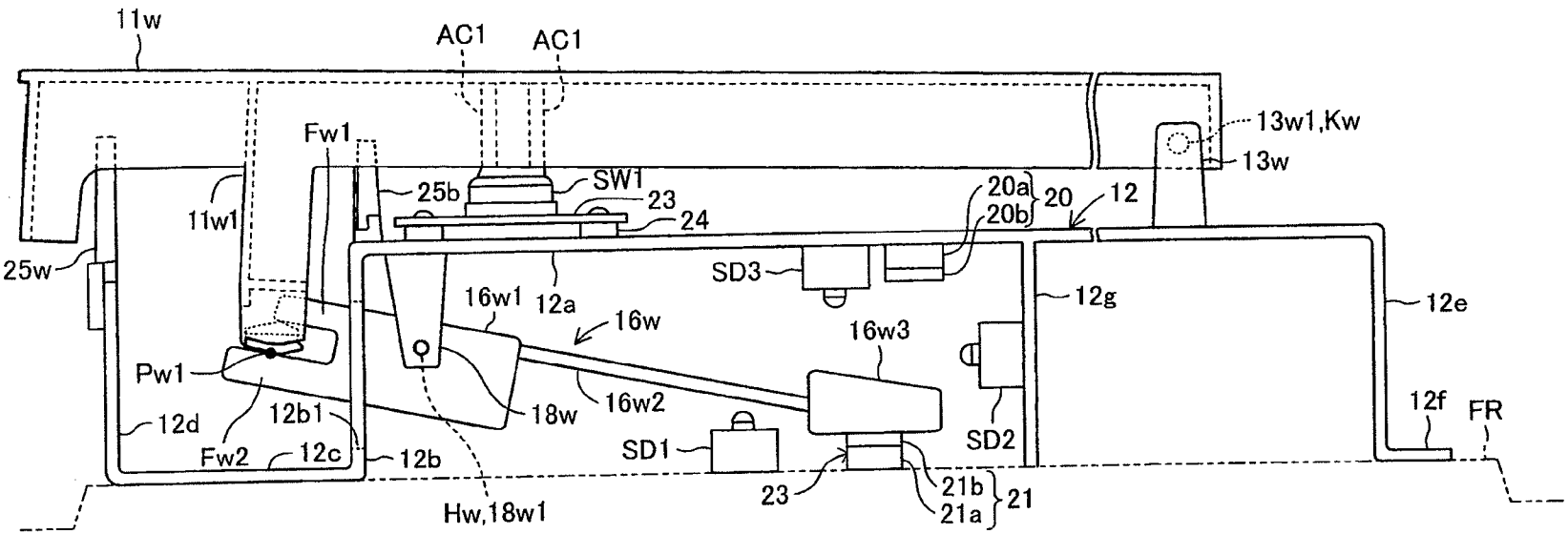
FIG. 8 is a right side view illustrating a configuration of a white key in a keyboard device according to another modification of the present invention.
Figure 9:
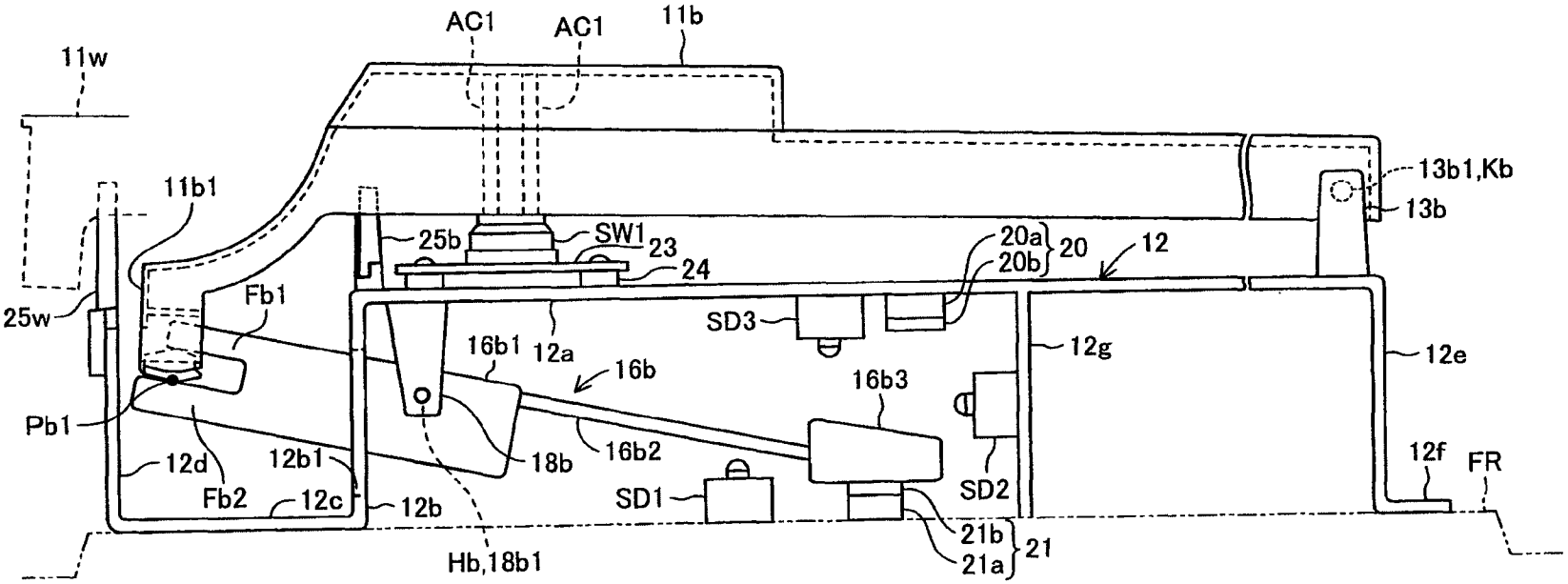
FIG. 9 is a right side view illustrating a configuration of a black key in a keyboard device according to another modification of the present invention.

For example, as illustrated in FIGS. 8 and 9, drive devices (e.g., solenoids SD1 to SD3) for driving the hammers 16*w* and 16*b* may be provided in addition to the configurations of the above-mentioned embodiment and above-mentioned modification. For example, the solenoids SD1 are arranged side by side in the lateral direction below the connection rod 16*w*2 and the connection rod 16*b*2. They are controlled by a controller provided to the electronic musical instrument to which this keyboard device is applied, whereby plungers move in the vertical direction. The plungers move the back ends of the hammers 16*w* and 16*b* respectively in the vertical direction, whereby the white key 11*w* and the black key 11*b* is depressed and released.

The solenoids SD2 are arranged side by side in the lateral direction on front surface of a vertical plate 12*g*, which extends downward from the lower surface of the top plate 12*a* at the middle part in the longitudinal direction and in the lateral direction. They are controlled by the controller in order that plungers move in the longitudinal direction. During the key depression, the controller allows the plungers to project forward, and to lightly collide with the back end surface of the mass member 16*w*3 and the back end surface of the mass member 16*b*3. On the other hand, during the key release, the controller allows the plungers to retreat backward to prevent the collision with the mass member 16*w*3 and the mass member 16*b*3. This structure generates a click feeling that a performer senses upon depressing a key of an acoustic piano.

The solenoids SD3 are arranged side by side in the lateral direction on the lower surface of the top plate 12*a*, and they are controlled by the controller in order that plungers move in the vertical direction. During the key depression, the controller allows the plungers to retreat upward, and upon the start of the key release, the controller allows the plungers to project downward to push downward the upper surface of the mass member 16*w*3 and the upper surface of the mass member 16*b*3, in order to quickly finish the key release operation. One or two of the solenoids SD1 to SD3 may only be provided.

The ranges of the rocking angle of the hammers are the same for all hammers as described above. Therefore, if the solenoids SD1 are arranged side by side in the lateral direction, and the projection amount of the plungers of the plural solenoids SD1 is controlled to be the same, the rocking angle of the plural hammers can be the same, and the depth of the key, which is engaged with the corresponding hammer, during the key depression can be the same. Accordingly, this can realize that all solenoids SD1 have the same characteristics. Specifically, it is unnecessary to make the characteristic of each solenoid SD1 different from each other according to the assigned pitch, with the result that the variety of the components can be reduced, and the cost for the keyboard device can be reduced.

If the solenoids SD2 are arranged side by side in the lateral direction, and the projection amount of the plungers of the plural solenoids SD2 is controlled to be the same as described above, the click feeling of the keys corresponding to the plural solenoids SD2 can be set uniform. Accordingly, this can realize that all solenoids SD2 have the same characteristics. Specifically, it is unnecessary to make the characteristic of each solenoid SD2 different from each other according to the assigned pitch, with the result that the variety of the components can be reduced, and the cost for the keyboard device can be reduced.

If the solenoids SD3 are arranged side by side in the lateral direction, and the plural solenoids SD3 are controlled to have the same driving force during the key release, the speed of the key release operation of the plural keys corresponding to the plural solenoids SD3 can be set to be equal. Accordingly, this can realize that all solenoids SD3 have the same characteristics. Specifically, it is unnecessary to make the characteristic of each solenoid SD3 different from each other according to the assigned pitch, with the result that the variety of the components can be reduced, and the cost for the keyboard device can be reduced. The drive device is not limited to the solenoid. The drive device may be a motor, or a device utilizing reaction force caused by a buckling spring or silicon rubber. The drive device may be a device that stops the hammer, or a device that imparts viscous resistance force against the driving force of the hammer (i.e., the key touch feeling).

Figure 10:
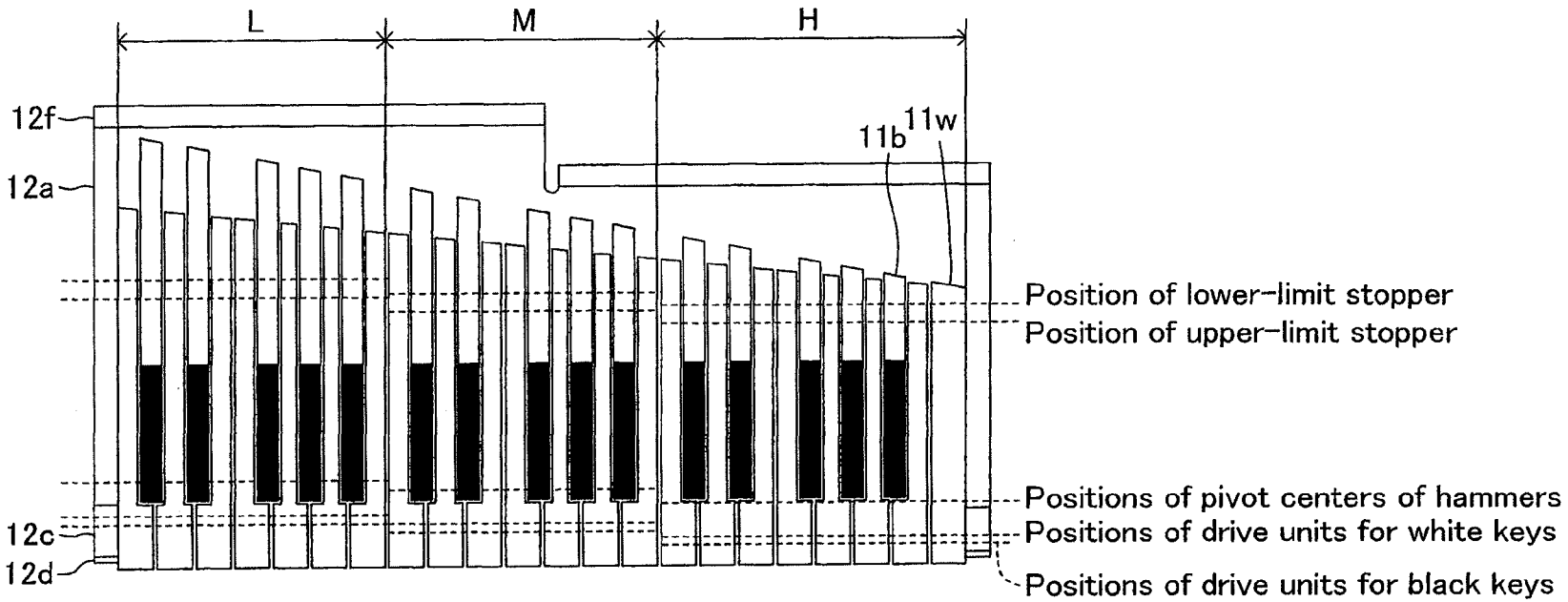
FIG. 10 is a plan view illustrating a keyboard device according to still another modification of the present invention.

For example, as illustrated in FIG. 10, the whole range is divided into a low-pitched part L, a middle-pitched part M, and a high-pitched part H, and the positions of the drive units, the positions of the pivot centers of the hammers, the position of the upper-limit stopper 21, and the position of the lower-limit stopper 20 (hereinafter referred to as positions of the respective portions) are set to be the same for each of the divided ranges. In this case, it is preferable that the length of each hammer in the longitudinal direction in each range is set to be the same. It is also preferable that the positions of the respective portions in the middle-pitched part M are slightly shifted forward of the positions of the respective portions in the low-pitched part L, and the positions of the respective portions in the high-pitched part H are slightly shifted forward of the positions of the respective portions in the middle-pitched part M. With this structure, the tilt angle of each of plural keys, each having a different pitch assigned thereto, during the key depression can be made close to one another.

In the embodiment described above and its modifications, the masses of the mass member 16*w*3 and the mass member 16*b*3 are adjusted to make the key touch feeling on the front end of the key gradually light toward the keys on the high-pitched side from the keys on the low-pitched side. However, the present invention is not necessarily configured as described above. The key touch feeling on the front end of the key in each range may be set to be the same, and the key touch feeling may be made light in a stepwise manner for each range toward the high-pitched range. It may also be configured such that the key touch feeling may become light in the order of pitches in only a certain range. Alternatively, it may be configured such that the key touch feeling may be set to be the same for all keys.

In the embodiment described above and its modifications, the length of the white key 11*w* becomes gradually shorter toward the white keys 11*w* on the high-pitched side from the white keys 11*w* on the low-pitched side, while the length of the black key 11*b* becomes gradually shorter toward the black keys 11*b* on the high-pitched side from the black keys 11*b* on the low-pitched side. However, the present invention is not necessarily configured as described above. The positions of the pivot centers of plural keys may be shifted in the longitudinal direction, and the positions of the respective portions for these keys may be set to be the same. For example, the whole range is divided into plural ranges, and the length of each of the keys belonging to each of the divided ranges may be set to be the same (i.e., the positions of the pivot centers of the keys in the longitudinal direction and in the vertical direction are set to be the same), while the length of the keys may be set to be different among the divided ranges. The positions of the respective portions in each of the divided plural ranges may be set to be the same. According to this configuration, the effect same as the above-mentioned embodiment can be obtained.

In the embodiment described above and its modifications, the length of each of the hammers in the longitudinal direction is set to be the same. However, the length of each of the hammers may be set to be gradually shorter toward the high-pitched side from the low-pitched side. In this case, the rate of change of the length of each hammer from the low-pitched side toward the high-pitched side may be set constant, and the lower-limit stopper 20 and the upper-limit stopper 21 on the high-pitched side may be arranged anterior to the lower-limit stopper 20 and the upper-limit stopper 21 on the low-pitched side. Specifically, the lower-limit stopper 20 and the upper-limit stopper 21 may be arranged diagonally, as viewed on a plane, in order that the ranges of the rocking angle of the hammers are the same for all hammers. With this structure, the number of components can be reduced, and the cost for the keyboard device can be reduced, compared to the case in which the stopper is provided for each hammer.

In the embodiment described above and its modifications, the white key 11*w* and the black key 11*b* are supported by the key support portions 13*w* and 13*b* of the key frame 12 by fitting the projections 13*w*1 and 13*b*1 to the through-holes Kw and Kb respectively so that the front ends of the white key 11*w* and the black key 11*b* can rock in the vertical direction. However, the white key 11*w* and the black key 11*b* can be mounted on the key frame 12 by using various supporting mechanisms, if the white key 11*w* and the black key 11*b* are supported by the key frame 12 so that the front ends of the white key 11*w* and the black key 11*b* can rock in vertical direction. For example, the rear ends of plural keys (the white key 11*w* and/or the black key 11*b*) may be are supported by the key frame 12 through elastic deformation members so that the front ends of the plural keys can rock in vertical direction. Concretely, the rear ends of the plural keys are connected to a fixing member fixed to the key frame 12 through thin and elastic connection members, wherein the fixing member is extended in the lateral direction, the connection members are extended horizontally or vertically, and the plural keys, the connection members and the fixing member are formed integrally. In this case, for example, the connection members for the white keys 11*w* are extended horizontally, and the connection members for the black keys 11*b* are extended vertically.

What is claimed is:

1. A keyboard device for an electronic musical instrument, the keyboard device comprising:

plural white keys and black keys that are supported by a key support portion in order that front ends thereof rock in the vertical direction by a key depression/release operation by a performer, wherein a pitch is assigned to each of the plural white keys and black keys, and a length from the front end to the key support portion is different among the plural white keys and black keys;

plural white-key hammers and black-key hammers, each of which includes an engagement portion engaged with each of the plural white keys and black keys, and each of which is supported by a hammer support portion in order to rock with the rocking movement of each of the plural white keys and black keys, wherein positions of the hammer support portions in the vertical direction and in the longitudinal direction are the same for the plural white-key hammers and black-key hammers, the positions of the engagement portions in the vertical direction and in the longitudinal direction during the key release state are the same for the plural white-key hammers, the positions of the engagement portions in the vertical direction and in the longitudinal direction during the key release state are the same for the plural black-key hammers, and the engagement portions of the plural black-key hammers are located anterior to the engagement portions of the plural white-key hammers; and a first restricting member and a second restricting member that are arranged to extend in the direction of the arrangement of the plural white keys and black keys, and that restrict the rocking movement of the plural white-key hammers and black-key hammers in order that the range of the rocking angle becomes the same for all of the plural white-key hammers and black-key hammers.

2. The keyboard device according to claim 1, wherein the distance from the front end of the white key to the engagement portion in the longitudinal direction is set within 30% of the distance from the front end of the white key to the key support portion of the white key in the longitudinal direction, and the distance from the front end of the black key to the engagement portion in the longitudinal direction is set within 30% of the distance from the front end of the black key to the key support portion of the black key in the longitudinal direction.

3. The keyboard device according to claim 1, wherein the distance from the leading end to the hammer support portion is the same for all of the plural white-key hammers and black-key hammers.

4. The keyboard device according to claim 3, wherein each of the plural white-key hammers includes a mass member that becomes light from a low-pitched side toward a high-pitched side, and a key touch feeling becomes gradually light from the low-pitched side toward the high-pitched side; and each of the plural black-key hammers includes a mass member that becomes light from a low-pitched side toward a high-pitched side, and a key touch feeling becomes gradually light from the low-pitched side toward the high-pitched side.

5. The keyboard device according to claim 4, wherein the mass member for the white-key hammer is heavier than the mass member for the neighboring black-key hammer.

6. The keyboard device according to claim 1, wherein the length from the front end to the back end of the plural white keys becomes shorter toward the high-pitched side from the low-pitched side, and the length from the front end to the back end of the plural black keys becomes shorter toward the high-pitched side from the low-pitched side.

7. The keyboard device according to claim 1, further comprising:

plural white-key operation detecting units and plural black-key operation detecting units that are arranged in a line in a direction of the arrangement of the plural white keys and black keys, each white-key operation detecting unit and black-key operation detecting unit detecting a physical amount involved with the rocking movement of each of the plural white keys and black keys respectively.

8. The keyboard device according to claim 7, wherein the distance from the front end of the white key to the white-key operation detecting unit corresponding to this white key in the longitudinal direction is set within 30% of the distance from the front end of the white key to the key support portion of the white key in the longitudinal direction, and the distance from the front end of the black key to the black-key operation detecting unit corresponding to this black key in the longitudinal direction is set within 30% of the distance from the front end of the black key to the key support portion of the black key in the longitudinal direction.

9. The keyboard device according to claim 7, wherein the white-key operation detecting unit is a switch for detecting whether the white key is depressed or released, and the black-key operation detecting unit is a switch for detecting whether the black key is depressed or released.

10. The keyboard device according to claim 1, further comprising:

plural white-key hammer operation detecting units and black-key hammer operation detecting units that are arranged in a line in a direction of the arrangement of the plural white keys and black keys, each white-key hammer operation detecting unit and black-key hammer operation detecting unit detecting a physical amount involved with the rocking movement of each of the plural white-key hammers and black-key hammers respectively.

11. The keyboard device according to claim 10, wherein the white-key hammer operation detecting unit is a switch for detecting whether the white key is depressed or released, and the black-key hammer operation detecting unit is a switch for detecting whether the black key is depressed or released.

12. The keyboard device according to claim 1 further comprising:

plural white-key hammer driving units and black-key hammer driving units that are arranged in a line in a direction of the arrangement of the plural white keys and black keys, each white-key hammer driving unit and black-key hammer driving unit driving each of the plural white-key hammers and each of the plural black-key hammers respectively.

* * * * *